United States Patent [19]

Shepard

[11] 4,015,648

[45] Apr. 5, 1977

[54] SAWMILL

[76] Inventor: Henry M. Shepard, c/o Forest-All Corporation, Sheep Davis Road, Concord, N.H. 03301

[22] Filed: Apr. 13, 1976

[21] Appl. No.: 676,427

Related U.S. Application Data

[63] Continuation of Ser. No. 455,965, March 29, 1974, abandoned.

[52] U.S. Cl. ..... 144/326 R; 83/102.1; 144/1 R;; 144/39; 144/118; 144/176; 144/312

[51] Int. Cl.[2] ..... B27C 1/02; B27C 9/00

[58] Field of Search ..... 144/3 R, 1 R, 39, 41, 144/114 R, 118, 116, 117 R, 117 B, 130, 134 R, 134 A, 162 R, 172, 309 R, 312, 326 R, 136 R, 176; 83/102.1

[56] References Cited

UNITED STATES PATENTS

| | | | |
|---|---|---|---|
| 1,421,204 | 6/1922 | Fritz | 144/39 |
| 3,259,157 | 7/1966 | Runnion | 144/172 X |
| 3,771,397 | 11/1973 | Smith | 83/102.1 |
| 3,838,722 | 10/1974 | Downing | 144/118 |

*Primary Examiner*—Othell M. Simpson
*Assistant Examiner*—W. D. Bray
*Attorney, Agent, or Firm*—C. Yardley Chittick

[57] ABSTRACT

A sawmill for cutting finished boards from logs in a single operation. The log is mounted on a reciprocating carriage which is also laterally adjustable to control the thickness of each board. Two vertically adjustable circular chippers are mounted on a vertical shaft. The spacing of the chippers controls the width of each board. A vertical saw is positioned with respect to the chippers so that the sides of the saw cut made through the log span the vertical cuts made by the chippers. The operation produces a maximum of sawdust.

7 Claims, 7 Drawing Figures

SAWMILL

RELATED APPLICATIONS

This application is a continuation of my pending application Ser. No. 455,965 filed Mar. 29, 1974 and now abandoned, for Sawmill.

FIELD OF THE INVENTION

Sawmills are in extensive use throughout the world. The conventional practice is to mount the log to be sawed on a reciprocating carriage and feed the log to a vertical saw which will be ordinarily a circular saw or a band saw. The first sawing operation removes the outside slab. This slab is waste as the outside of the slab is the curved outer surface of the log. The carriage is then returned to starting position, the carriage is moved laterally a distance slightly more than the thickness of the board to be cut, the log is advanced to the saw which saws from the log a board having sawed faces but unfinished edges. This board must then be fed through an edger which produces two long thin waste strips or battens as the edges of the board are trimmed.

In order to make economic use of the sawmill waste, chippers have been devised which chip up the waste wood produced in the conventional sawing operation or which chip away from the log at a position in advance of the sawing operation those parts of the log which would ordinarily be subsequently removed by the edger. In this way more wood is converted at once to chips which are usable in paper making.

SUMMARY OF THE INVENTION

The present invention is an advance over the prior art in that in a single operation the sawmill produces a board finished on both sides and both edges and reduces all of the other portions of the log to chips excepting the sawdust produced by the cutting action of the saw. The sawmill incorporating the present invention produces a succession of boards usually of increasing width and determinable thickness until about one-half of the log is consumed. The remaining part of the log is then rotated 90° or 180° according to the widths of boards required and the operations are repeated.

An important feature of the invention lies in the construction and adjustability of the chippers, of which there are only two. These chippers are of equal diameter and preferably of equal size and are mounted in controlled vertical positions on a very strong rotating shaft. The chippers rotating at suitable speeds chip away all wood which is not engaged by the saw. Thus, when the log reaches the saw, all wood above and below the edges of the board to be cut has been removed as chips. The board edges are created by the chippers which are so designed as to be able to produce an edge surface acceptable to the trade at this stage of lumber processing. The edge surface is normally a narrow plane surface at a right angle to the faces of the board. However, the chippers may be designed to create board edges of other configurations within the scope of the invention. In addition, the chippers, when moved to abutting positions on their shaft, chip away all wood which would normally be cut off as the outer slab.

The other important feature of the invention is found in the location of the saw in relation to the vertical wall or walls created by the chippers as the log passes thereby en route to the saw.

The plane of the saw, whether circular or band, is parallel to the axis of the shaft carrying the chippers. In addition, the plane of the vertical surfaces produced by the chippers when extended to the saw, will, in the preferred arrangement, pass within and between the two sides of the saw. Thus, the saw in cutting the board from the log will also trim away the vertical surfaces formed by the chippers at those areas above and below the edges of the board. In this way the outer surface of the next board will have a uniform appearance which is the result of the whole surface having been engaged by the teeth on one side of the saw.

These features of construction and objects of the invention will become more apparent as the description proceeds with the aid of the accompanying drawings in which FIG. 1 is a perspective view showing the general relation of the parts.

DESCRIPTION OF A PREFERRED EMBODIMENT

Figures 1, 7:
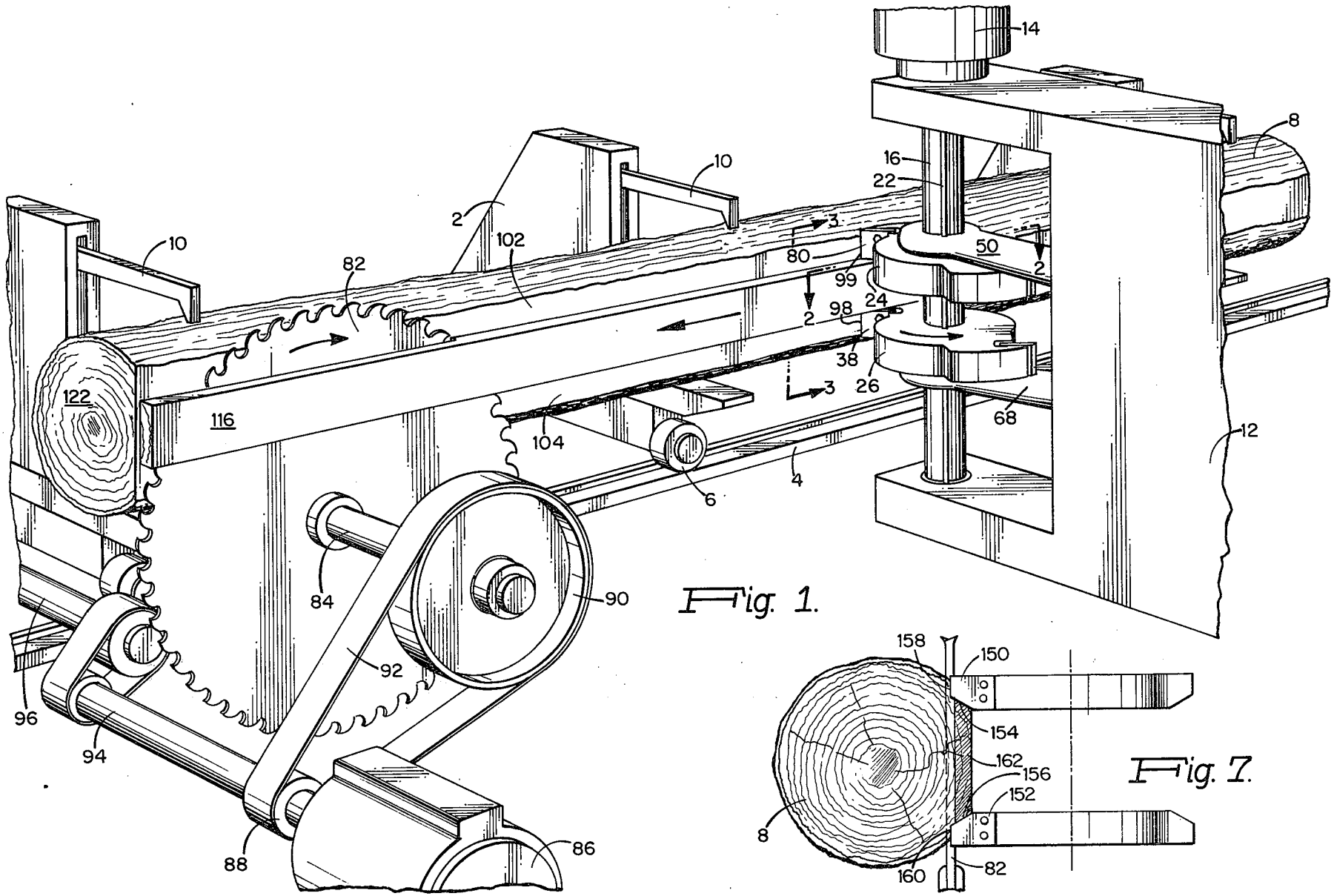
FIG. 7 shows an alternative chipper design for creating non-parallel board edges.

Referring first to FIG. 1, the sawmill comprises a conventional carriage 2 which includes tracks 4 and wheels 6 on which the carriage 2 may move back and forth. A log 8 is held in secure position on the carriage by means of grippers 10 of which there are as many as needed to insure that the log cannot become dislodged as the chipping and sawing operations are performed on it. Conventional means is used for moving the carriage back and forth on the tracks 4 as the sawing of the log proceeds.

Figure 2:
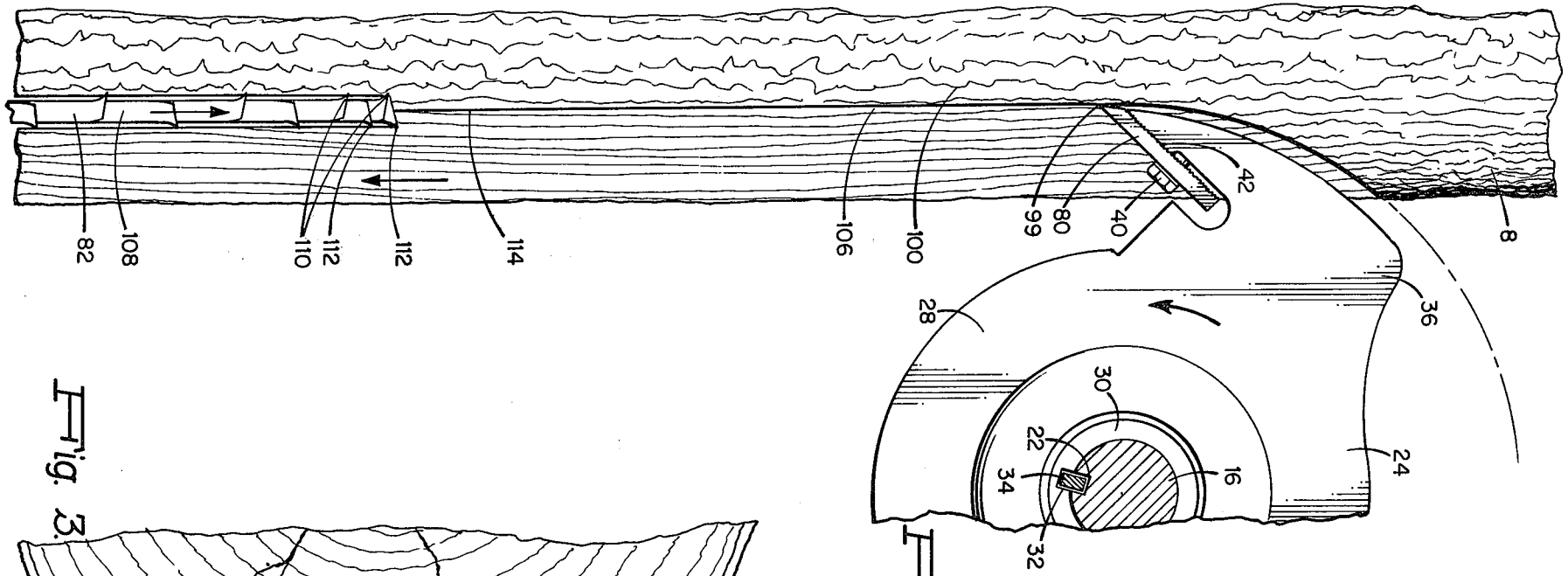
FIG. 2 is an enlarged horizontal section taken generally on the line 2—2 of FIG. 1.
Figure 5:
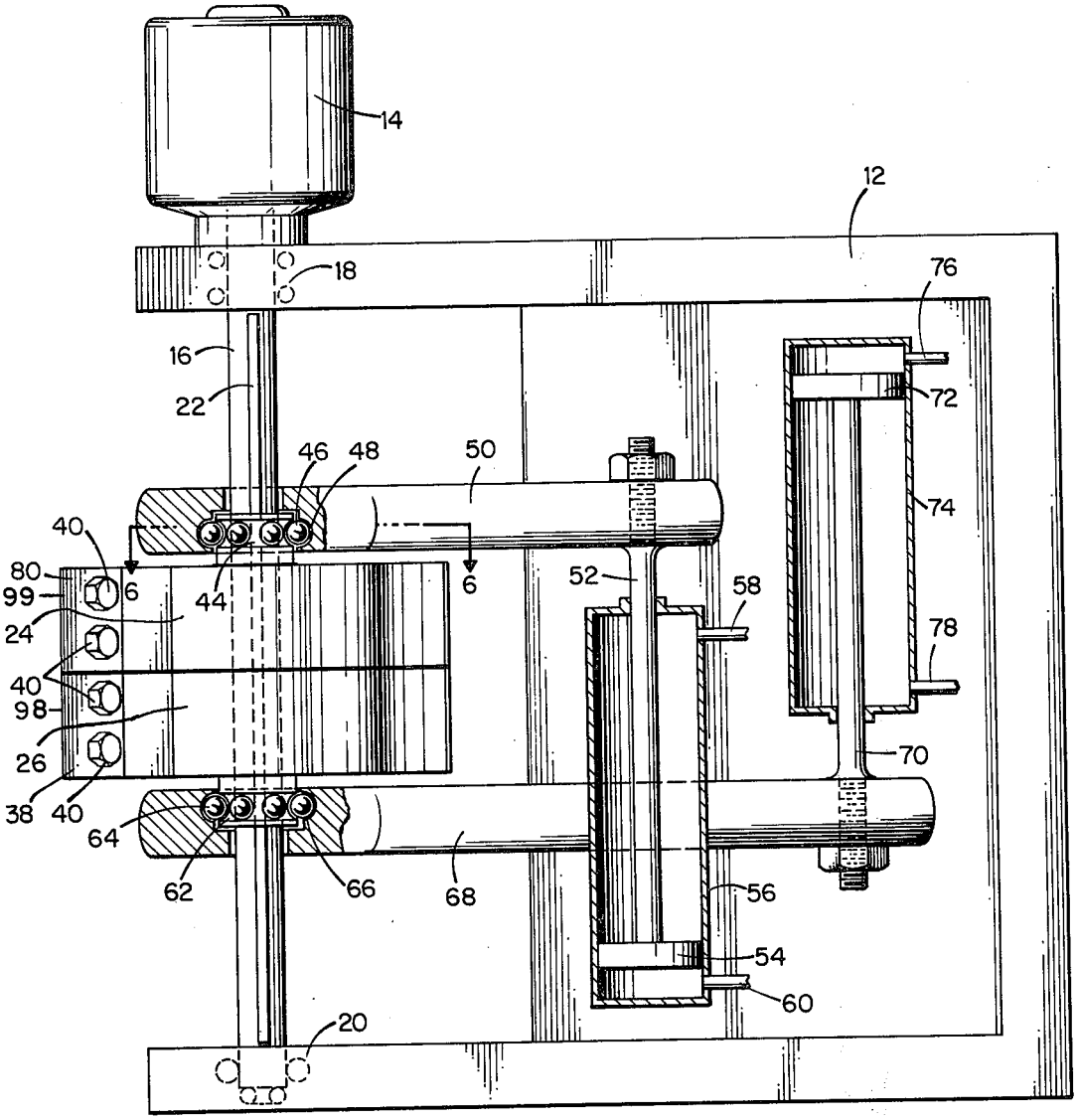
FIG. 5 illustrates somewhat schematically the mechanism used to move the chippers on their vertical driving shaft.
Figure 6:
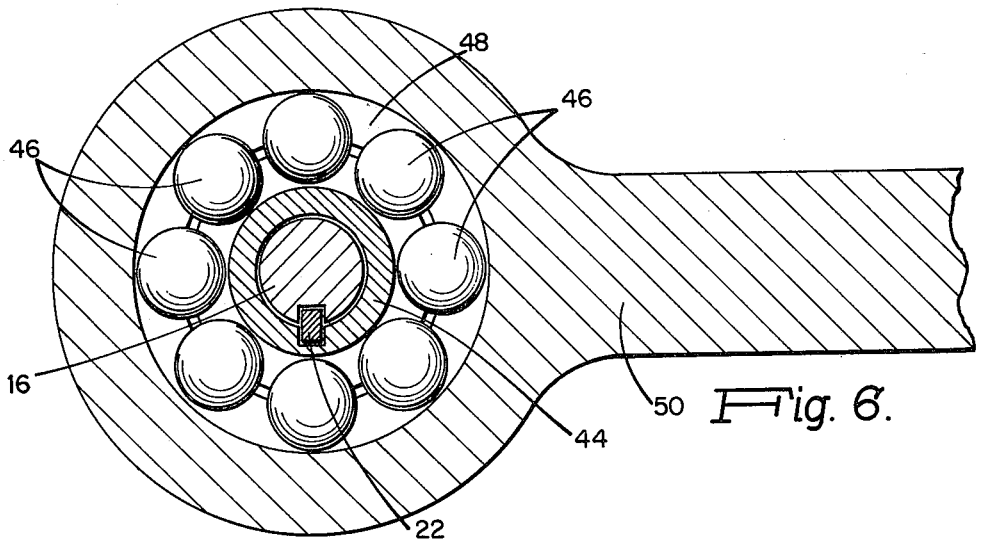
FIG. 6 is a horizontal section on line 6—6 of FIG. 5 showing in larger scale the manner in which the chippers are keyed to the vertical drive shaft and the supporting rotatable bearings.

The mechanism for driving the chippers is shown in FIGS. 1, 5, and 6, and the chippers per se are shown in FIGS. 1 and 2.

A supporting housing 12 is positioned adjacent the tracks 4 and the carriage 2. A motor 14, mounted at any convenient location which as shown may be on the top of housing 12, drives a shaft 16 which is suitably maintained at its upper and lower ends by bearings 18 and 20. The motor shaft and bearing structure are exceptionally sturdy and rigid so that during the chipping operations the chippers cannot deviate laterally from their normal chipping paths. Shaft 16 has a longitudinal keyway 22 extending for its full length. The keyway serves the purpose of securing the chippers to the shaft 16 for rotation and permitting the chippers to be shifted to selected vertical positions.

Referring to FIGS. 1 and 2, the two chippers are shown at 24 and 26. Each chipper comprises a rigid body portion 28 having a bearing 30 within which is shaft 16. The interior of bearing 30 includes a keyway 32 which is aligned with and keyed to keyway 22 by a key 34 which is held by suitable means from vertical disengagement with keyway 32.

The body of each chipper has a plurality of equally spaced shoulders 36 which are shaped to receive cutters 38 and 80 which are held in cutting position by any suitable means such as headed screws 40. It is customary to utilize cooperating serrations on the body and cutter as indicated at 42 to insure that the cutter will not be dislodged during operation.

The two chippers are arranged for vertical movement on shaft 16 whereby they may be positioned at appropriate locations according to the requirements of the board about to be cut from the log. A suitable means for maintaining the chippers in position on shaft 16 is illustrated in FIG. 5. The upper chipper 24 has an interior circular race 44 which, through the use of a plurality of ball bearings 46 cooperates with an exterior race 48 located within the end of arm 50. Shaft 16 keyed to chipper 24 extends vertically through the concentric races.

The other end of arm 50 is securely mounted on the upper end of a piston rod 52 whose piston 54 on the lower end thereof is located within a hydraulic or air cylinder 56. Supply pipes 58 and 60 feed fluid or air to and from the cylinder to cause appropriate up or down movement of piston 54 and the associated chipper 24 to a location on shaft 16 appropriate for the chipping operation to be performed.

Similarly, chipper 26 has on its lower side an interior race 62 which, through the use of ball bearings 64, cooperates with an exterior race 66 located within the end of arm 68. The other end of arm 68 is securely mounted on the lower end of piston rod 70 whose piston 72 fits within cylinder 74. Supply pipes 76 and 78 permit the introduction and removal of fluid or air to cylinder 74 so that by moving piston 72 up and down, chipper 26 may be located on shaft 16 at an appropriate position to perform the required chipping operation with respect to the board then about to be sawed from the log. While hydraulic or air actuated means have been disclosed as the mechanism for adjusting the positions of the chippers, it will be understood that other means for controlling the chipper locations are within the scope of the invention. For example, mechanical means driven by a reversible electric motor could be used.

It will be noted in FIG. 5 that the two chippers 24 and 26 may be shifted vertically on shaft 16 to be brought into face to face engagement. In this position, the cutter 38 on the lower chipper 26 and the cutter 80 on the upper chipper 24, even though staggered in relation to each other, act as if they constituted a single cutter extending the full vertical distance of the two chipper bodies. The chippers when in an abutting position are capable of reducing to chips the wood that would according to the prior practice be the outside slab cut from the log.

Referring again to FIG. 1, the log, as it advances to the left, moves from the chipping position at station 12 to a sawing position at which is located a saw 82. This saw, as shown, is a circular saw, but it will be understood that other conventional saws, such as a band saw or a reciprocating saw, may be used. The saw 82 is mounted on a rigid horizontal shaft 84 and driven by a motor 86 through pulleys 88 and 90 and belt 92. The motor 86 also drives other mechanism through shafts 94 and 96 which actuates the carriage reciprocating mechanism. Since the carriage and its drive means are all conventional in the industry, it is not deemed necessary to show the details of such mechanism.

An important feature of the invention is the positioning of the saw with relation to the circular paths of the cutting edges 98 and 99 of the cutters 38 and 80. Referring to FIG. 2 in which a portion of a log 8 is indicated at 100, it will be understood that the log is advanced by the carriage 2 along a fixed path determined by the rails 4. The vertical surfaces indicated at 102 and 104 in FIG. 1 and at 106 in FIG. 2 produced by the cutters are necessarily parallel to the line of travel of the carriage.

The saw 82, of which part is shown in FIG. 2, is aligned with the vertical walls produced by the cutters so that the vertical plane of the walls when extended forwardly to the saw, will lie between and be parallel to the two vertical sides of the saw. This is plainly shown in FIG. 2 in which the left side of the saw indicated by the maximum extent of teeth 110 and the right side of the saw indicated by the maximum extent of the teeth 112 will lie on either side of the extended plane 114 of the vertical wall 106.

The object of the construction just explained is to insure that when the saw 82 saws a board 116 from log 8, the saw will also trim off a small amount of wood from the vertical surfaces previously created by the chippers as the log advances thereby. In this way, the entire vertical surface of the outer face of the next board to be sawed from the log will be a surface of uniform appearance and texture because the saw teeth 110 will have been in engagement with the entire vertical surface and will have trimmed away the vertical surfaces previously created by the chippers.

The carriage 2 advances far enough so that the entire length of log 8 will pass by the saw 82 thereby producing a finished board. This board conventionally falls on a conveyor which removes it to a suitable location.

Figure 4:
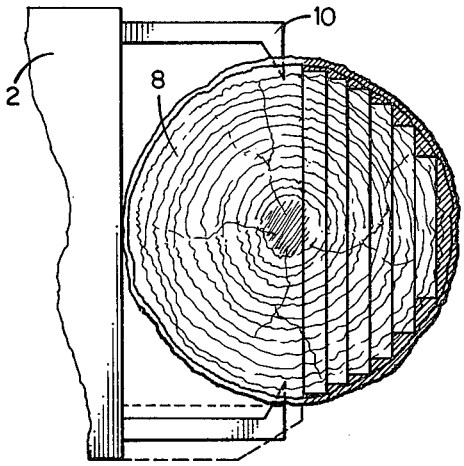
FIG. 4 is a vertical section of a log illustrating in the shaded part the wood that is removed as chips and the boards whose vertical faces are cut by the saw and whose horizontal edges are fashioned by the chippers.
Figure 3:
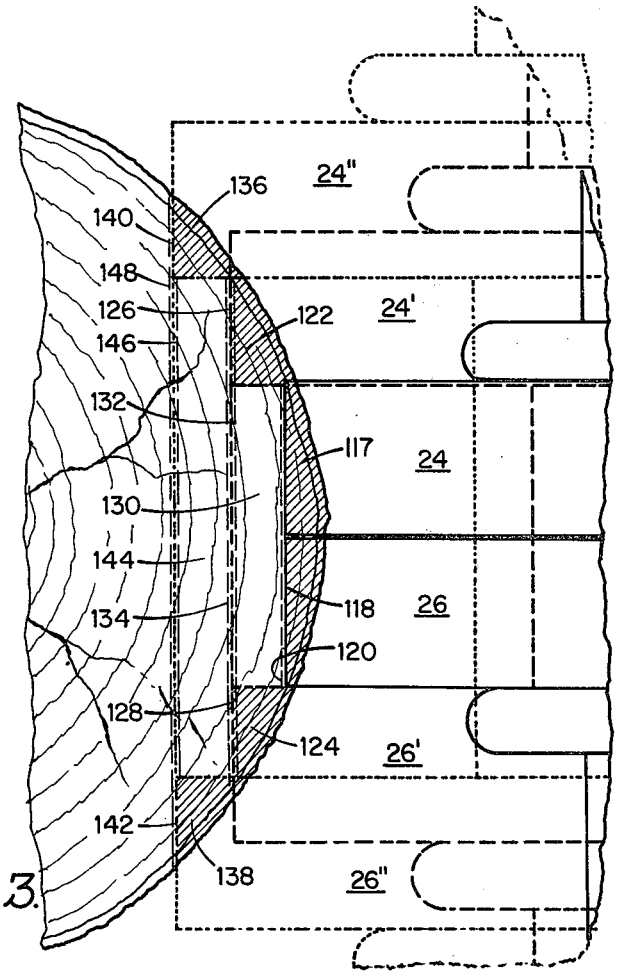
FIG. 3 is a fragmentary vertical section of a log taken on the line 3—3 of FIG. 1, showing the relation of the log to three different settings of the two chippers.

Referring now to FIGS. 3 and 4, a more detailed explanation will be given of the manner in which the log is first chipped and boards are thereafter cut from the log.

In FIG. 3 the chippers 24 and 26 abutt each other and the log, on passing the chippers, has removed from it in chip form the wood indicated at 117 leaving a vertical surface 118 as the log leaves the chippers. Since, as previously explained, the saw 82 is positioned so the opposite surfaces of the saw 82 straddle the surface 118, the saw will trim away a small quantity of that surface so that the new trimmed surface is now indicated at 120.

After passing saw 82, the log is returned by the carriage to a position where its leading end 122 is beyond the chippers. The carriage 2 is then moved laterally in accord with conventional construction, a distance toward the chippers and the saw sufficient to produce the required thickness of the first board to be cut from the log. Likewise, the chippers 24 and 26 are separated to a new position as indicated in FIG. 3 at 24′ and 26′. The carriage is then advanced as before and when the log reaches the chippers they will cut away those areas indicated in FIG. 3 and at 122 and 124 producing vertical surfaces 126 and 128. The log continues its advance and reaches saw 82 which, as previously explained, has its sides straddling the plane of the vertical surfaces 126 and 128 just produced by the chippers. Accordingly, the saw, in cutting off board 130 indicated in FIG. 3, will reduce the thickness of the board to the dotted line 132 and will trim off the outer face of the next board to be cut to the line 134. After board 130 has been completely cut from the log, the carriage and the log are returned to starting position beyond the chippers. The carriage and the log are then moved laterally a distance sufficient to produce the thickness of the next board to be cut and the chippers are separated further to new positions 24'' and 26''. The log is again fed past the chippers which chip away the wood indicated at 136 and 138 in FIG. 3 and create new vertical walls 140 and 142.

The log continues its advance to saw 82 and the saw cuts off board 144 having its outer face at 134 and its inner face at 146. The face of the next board to be cut will be at the dotted line 148.

The foregoing steps of positioning the log laterally toward the chippers and saw and spacing the chippers progressively farther apart and sawing the board from the log is repeated until the maximum width of board is reached as indicated in FIG. 4. In this illustration it is shown that six boards have been cut from the log and all of the wood exterior thereof has been reduced by the chippers to chips of a size having economic value for subsequent uses as, for example, in the paper making industry.

After removing as many boards as possible or desired from one side of the log, the log is rotated through 90° or 180° by devices well known in the art and then the chipping and sawing operation heretofore described are repeated. In this way, a log is effectively reduced to a plurality of boards of desired width and thickness and all of the remaining portions of the log are reduced principally to chips and to a minimum of sawdust created by the saw.

While in the preferred form, the cutters 38 and 80 will be shaped to produce horizontal edges on the boards in the manner heretofore explained, it will also be understood that the cutters may be designed to produce nonhorizontal board edges as suggested in FIG. 7. Here the cutters 150 and 152 produce sloping edges 154 and 156 along with the vertical surfaces 158 and 160. These vertical surfaces will be trimmed off by saw 82 at the same time that board 162 is sawed from the log 8. Other configuration for board edges will readily suggest themselves.

The use of the term "board" as representing the piece of wood that is cut from the log is not to be construed as a limitation. "Board" is intended to include any piece of wood that the saw removes from the log regardless of what it may be called in the trade. The term "chips" include chips of any size produced by the chippers as distinguished from sawdust produced by the saw.

It is to be understood that when it is stated in the specification that the surfaces produced by the chippers are vertical and that the saw is vertical, this is for the purpose of explaining the normal orientation of the mechanism. The invention, however, also contemplates any alternative positioning of the parts in which the chipping surfaces and saw might be in a plane other than vertical. It will also be understood that the horizontal or other edge surfaces produced by the chippers (which surfaces are the upper and lower narrow edges of the board about to be cut) are preferably of such character as to be acceptable to the trade at this stage in the production of lumber.

It is also understood that the number of boards to be cut from the log while the log is in a fixed position on the carriage may be varied as desired. Likewise, the width and thickness of the boards may be controlled according to production requirements. The log, after having some boards cut from one side, may be rotated by known means through any desired angle, normally 90° or 180° for further cutting.

In general, the machine herein claimed is capable of reducing a log to boards of selected dimensions with a minimum of waste in the form of chips and some sawdust.

It is intended to cover all changes and modifications of the example of the invention herein chosen for purposes of the disclosure which do not constitute departures from the spirit and scope of the invention.

I claim

1. A machine for cutting a log into boards, said machine comprising a pair of chippers mounted in axially movable and keyed relation on a vertical shaft, means for rotating said shaft and chippers at proper chipping speed, each said chipper including cutting edges defining circular paths which will produce simultaneously first vertical and horizontal surfaces on the said log, means for moving said chippers to and maintaining them at determinable vertical positions on said shaft, a reciprocable horizontal carriage, means for securing a log thereon, means for lateral adjustment of said carriage so that the said log will be engaged by the cutting edges of said chippers as the log passes thereby to produce said vertical and horizontal surfaces, a vertically positioned saw whose faces are parallel to the axis of said shaft and the direction of movement of said carriage, said saw located beyond said chippers so that an advancing log will first engage said chippers and then engage said saw, the cutting edges of said chippers being disposed within the planes defined by the parallel faces of said saw whereby as a board is cut from said log said first vertical surfaces are replaced by saw produced vertical surfaces.

2. The machine set forth in claim 1 and the means for moving said chippers vertically on said vertical shaft comprising grooved cylindrical races on the upper side of the upper chipper and grooved cylindrical races on the lower side of the lower chipper; arms having complementary races with anti-friction bearings therebetween and means operable under the control of an operator to move each said chipper up or down to desired positions.

3. The machine set forth in claim 1, said mounting and moving means for said chippers permitting said chippers to be placed in abutting position whereby they may act in cooperation to produce a single vertical starting face on the side of said log, which face will immediately thereafter be trimmed away by said saw.

4. The machine set forth in claim 1, said chippers being moveable on said shaft from a position in which they abut each other to spaced apart positions at which the distance between opposing faces of said chippers is at least as great as the width of the widest board to be cut from said log.

5. A machine for cutting a log into boards comprising a reciprocable carriage on which a log may be mounted, a pair of cylindrical chippers of equal diameter and of substantial vertical dimensions mounted for rotation on a vertical shaft, each of said chippers comprised of cutters having cutting edges defining circular paths which will produce simultaneously vertical and horizontal intersecting surfaces in said log, means for moving said chippers to selected spaced positions on said shaft, means for moving said carriage laterally to selected positions, a vertical saw whose center vertical plane is substantially tangent to the circular path of said cutting edges and means for advancing said carriage so that said log first engages said spaced chippers to produce simultaneously two spaced aligned vertical surfaces and two spaced horizontal surfaces, each said vertical surface intersecting a horizontal surface, said advancing carriage then causing said log to engage said saw whereby a board may be sawed from said log and the said aligned vertical surfaces produced by said cutters on the face of the next board to be sawed will be simultaneously removed by said saw.

6. The method of cutting boards from a log comprising the steps of securing the log to a moveable table, moving the log forward along an accurately defined straight path to be engaged sequentially by chipping and sawing means, chipping in a circular horizontal direction only into the moving log at two only spaced vertical positions to create simultaneously two longitudinal notches defined by two spaced narrow upper and lower non-vertical surfaces and two spaced aligned vertical walls extending from the outer surface of the log inwardly and intersecting the inner edges of said narrow non-vertical surfaces, continuing the movement of said log into engagement with a vertical saw so located that the line of intersection of said non-vertical surfaces and their respective adjacent vertical walls will be intermediate the sides of the cut to be made by said vertical saw, then returning the log longitudinally to its original position, moving the log laterally toward said chippers and then repeating the aforesaid steps whereby the vertical walls produced by said chipping operation will immediately thereafter be trimmed by said saw and said non-vertical surfaces will be unchanged.

7. The method of cutting boards from a log mounted on a reciprocating carriage comprising the steps of first progressively chipping away sufficient wood on the side of a log moving on said carriage along a fixed path to produce a first vertical longitudinal surface, continuing movement of said log along said fixed path to engage a vertical saw positioned to trim said first vertical surface and thereby to create a new continuous saw finished surface, returning said log on said carriage to starting position, moving said log laterally toward said chippers, moving said carriage and log along said fixed path and simultaneously chipping away upper and lower portions of said log to create two parallel longitudinal notches, each notch defined by a narrow non-vertical face whose outer edge intersects the said first vertical saw finished surface and by a vertical surface, each said vertical surface intersecting the inner edge of its related said non-vertical face and the outer surface of said log, continuing the movement of said carriage and log along said fixed path to again engage said saw to cut a first board from said log and simultaneously to trim each vertical surface of said notches to create a second continuous saw finished vertical surface which is wider than the said previously created vertical saw finished surface, and returning said carriage and log to starting position and repeating the last mentioned chipping and sawing operations.

* * * * *